United States Patent [19]

Davis

[11] 4,349,778

[45] Sep. 14, 1982

[54] BAND-GAP VOLTAGE REFERENCE HAVING AN IMPROVED CURRENT MIRROR CIRCUIT

[75] Inventor: William F. Davis, Tempe, Ariz.

[73] Assignee: Motorola, Inc., Schaumburg, Ill.

[21] Appl. No.: 262,273

[22] Filed: May 11, 1981

[51] Int. Cl.[3] ..... G05F 3/20

[52] U.S. Cl. ..... 323/314; 307/297

[58] Field of Search ..... 307/296 R, 297; 323/312, 313, 314, 315

[56] References Cited

U.S. PATENT DOCUMENTS

| | | | |
|---|---|---|---|
| 3,887,863 | 6/1975 | Brokaw | 323/314 |
| 4,085,359 | 4/1978 | Ahmed | 323/314 |
| 4,087,758 | 5/1978 | Hareyama | 323/314 |

*Primary Examiner*—William M. Shoop

*Attorney, Agent, or Firm*—Vincent B. Ingrassia

[57] ABSTRACT

The disclosed band-gap voltage reference circuit has an NPN feedback path for minimizing the value of the frequency compensation capacitor and for rejecting power supply line voltage variations. The feedback path includes a current mirror circuit which is comprised of a diode and a transistor which are connected between the collector electrodes of the transistors of a band-gap voltage reference cell. Balanced current supply circuits are also connected to the collector electrodes of the voltage reference cell transistors. The output voltage of the cell is utilized to clamp the voltages across the current supplies at substantially equal magnitudes so that voltage changes across the current supplies, due to line voltage variations for instance, do not deleteriously affect the regulating action of the voltage regulator cell.

12 Claims, 2 Drawing Figures

- PRIOR ART -

BAND-GAP VOLTAGE REFERENCE HAVING AN IMPROVED CURRENT MIRROR CIRCUIT

BACKGROUND OF THE INVENTION

1. Field of the Invention

This invention relates to regulated, direct current (dc) voltage supplies. More particularly, this invention relates to solid-state, band-gap voltage references which are capable of maintaining a dc output voltage having a substantially constant magnitude even while being subjected to power supply voltage variations and which require compensation capacitances of minimum size.

2. Description of the Prior Art

U.S. Pat. No. 3,887,863 ('863) of Adrian Paul Brokaw, discloses a two-transistor band-gap voltage reference source or cell wherein the ratio of current densities of the two transistors is automatically controlled to a predetermined magnitude by a negative feedback amplifier. A voltage having a positive temperature coefficient (TC) corresponding to the difference in base-to-emitter voltages ($\Delta V_{BE}$) of the two transistors is developed and connected in series with the base-to-emitter voltage ($V_{BE}$) of one of the two transistors having a negative TC to form a composite voltage at the base of the transistor. The circuit parameters can be selected so that a composite reference voltage having a magnitude near the band-gap voltage of silicon and a low or minimal temperature coefficient is provided.

If output voltages having greater magnitudes are desired then a voltage divider network comprising two series-connected resistors can be connected to the output terminal of the negative feedback amplifier. A common junction between these resistors is connected to the commonly connected bases of the two reference transistors. The divider provides a reference voltage which is a predetermined fraction of the output voltage to the junction. Therefore, the magnitude of the resulting output voltage at the output of the negative feedback amplifier can be a predetermined multiple of the reference or bandgap voltage.

The negative feedback path of FIG. 4 of the foregoing '863 Brokaw patent includes a PNP current mirror which converts the differential output signals of the two transistor voltage reference source into a single-ended signal. The PNP current mirror is coupled through a voltage level shifting stage to an NPN Darlington output driver stage which is coupled to the aforementioned series-connected resistors. More specifically, the current mirror includes three PNP transistors. The first PNP transistor has a base electrode connected to the collector electrode of one of the two transistors of the voltage reference source. The collector electrode of the first mirror transistor is connected to the negative supply conductor. A second of the PNP current mirror transistors has a collector electrode connected to the base electrode of the first current mirror transistor and to the collector electrode of the one voltage reference source transistor. The third PNP current mirror transistor has a collector electrode connected to the collector electrode of the other voltage reference transistor, and a base electrode connected to the base electrode of the second current mirror transistor and to the emitter of the first current mirror transistor. The emitter electrodes of the second and third current mirror transistors are each electrically connected to a common conductor which is coupled through a power supply voltage pre-regulator circuit to the positive d.c. power supply line.

During operation, assume that the collector voltage of the first reference source transistor drives the base of the first current mirror transistor toward the negative level. The first current mirror transistor, acting as an emitter-follower, then renders the other two current mirror transistors conductive until the magnitude of their collector currents approximately equals the magnitude of the collector current of the first reference source transistor. Since the base-to-emitter junctions of the second and third current mirror transistors are connected in parallel, the collector current of the third current mirror transistor is approximately equal to or "mirrors" the collector currents of the second current mirror transistor and the first reference source transistor. This desirable condition exists only so long as the voltage between the negative power supply conductor and the common conductor has a constant magnitude. Since the d.c. power supply voltage varies for many reasons, such as ripple for instance, usage of the aforementioned power supply pre-regulator circuitry is required which adds complexity and reduces yields thereby undesirably increasing the cost of the integrated circuit. If the separate power supply voltage regulator is not employed then problems result from the different base width modulations of the transistors of the reference cell in response to power supply voltage variation causing current imbalance therein as pointed out in column 6, line 60 of the foregoing '863 Brokaw patent.

The foregoing problem is also discussed hereinafter wih respect to FIG. 1 hereof which relates to another "modified" version of the Brokaw circuit and which is prior art to the subject invention.

The process and geometry utilized in manufacturing the three PNP mirror transistors commonly used in such bipolar integrated circuits results in such devices having poor frequency responses and low gains. Thus, the PNP current mirror utilized in the above-described feedback path tends to have a poor frequency response which results in phase and stability problems, thereby requiring a frequency compensation capacitance having a high value and thereby taking up an undesirable amount of die area. The frequency compensation capacitor is connected between the collector electrode of the third current mirror transistor and the negative supply conductor. Also, the large capacitor undesirably slows down the regulator reaction time in response to transients.

3. Objects of the Invention

It is therefore an object of the present invention to provide general purpose voltage reference sources having relatively simple configurations as compared to prior art circuits.

Another object of the invention is to provide simple general purpose voltage reference sources having a high degree of rejection to the variation of the magnitude of the power supply line voltages.

Still a further object of the invention is to provide a band-gap voltage reference source which requires a frequency compensation capacitor of minimum size.

SUMMARY OF THE INVENTION

In brief, a voltage reference circuit of one embodiment of the invention provides a reference voltage having a constant magnitude at an output terminal thereof even though subjected to a varying power supply voltage. The voltage reference circuit includes first and second voltage reference transistors of a particular conductivity type. A diode means and a further transistor means of the particular conductivity type are included in a differential-to-single ended converter coupled between the collector electrodes of the voltage reference transistors. A feedback transistor is connected between the further transistor and the regulator output which is coupled to the commonly connected base electrodes of the reference transistors. The diode and the base-to-emitter junction of the feedback transistor clamp the voltages across current supplies connected to the differential-to-single ended converter to a level just above the regulated output level. As a result, substantially zero differential current is created in the voltage reference circuit in response to variations in the power supply line voltage. Furthermore, the configuration enables an NPN transistor to be used in the signal control path so that the size of a frequency compensation capacitor connected to the base electrode of the output transistor is minimized.

DETAILED DESCRIPTION OF THE PREFERRED EMBODIMENT

Figure 1:
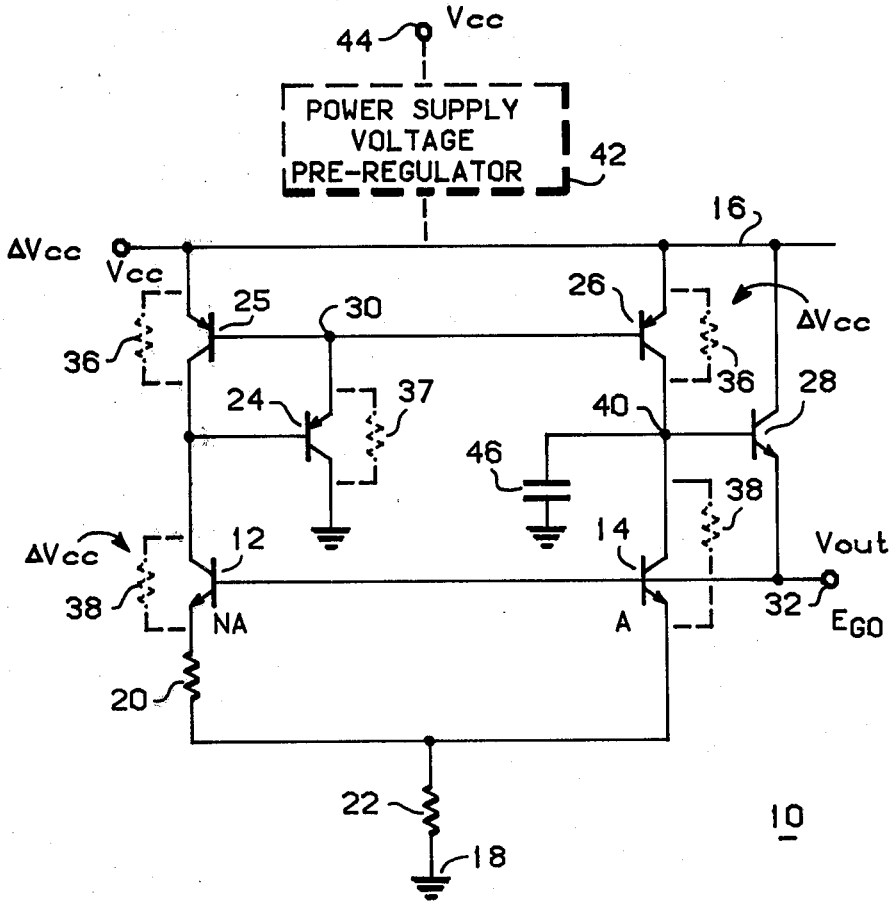
FIG. 1 is a schematic diagram of a prior art voltage reference source.

FIG. 1 is a diagram of a prior art regulating reference voltage source circuit 10 which includes a PNP current mirror circuit and which has a low degree of rejection to variation in power supply line voltages applied between lines or conductors 16 and 18 and which requires an undesirably large frequency compensation capacitor. Circuit 10 includes a pair of NPN voltage reference transistors 12 and 14 having emitter, base and collector electrodes which are supplied with operating voltages and currents from positive and negative supply conductors 16 and 18, respectively. The emitter electrode of transistor 12 is coupled through two series-connected resistors 20 and 22 to the negative supply conductor 81 and the emitter electrode of transistor 14 is coupled through resistor 22 to conductor 18.

Transistors 12 and 14 are operated at different but constant emitter current densities to produce a voltage proportional to the difference in the two transistor base-to-emitter voltages referred to as $\Delta V_{BE}$. More specifically, transistor 14 is operated at a larger current density than transistor 12. There are many known ways of creating unequal current densities, but one common way is to scale the emitters of transistors 12 and 14 where the area of the emitter of transistor 12 is some multiple N of the area of transistor 14, with N being greater than 1. To facilitate layout, N is usually equal to 8.

The emitter currents of transistors 12 and 14 are required to have equal magnitudes. The magnitudes of the currents through transistors 12 and 14 are required to be equal for proper voltage regulation to be accomplished and the negative feedback arrangement, including PNP transistors 24, 25, 26 and NPN transistor 28, attempts to accomplish this result. The collector electrode of transistor 24 is connected to conductor 18. The collector electrode of transistor 25 is connected to the collector electrode of voltage reference transistor 12 and to the base electrode of transistor 24. The collector electrode of PNP transistor 26 is connected to the collector electrode of voltage reference transistor 14 and to the base electrode of NPN output transistor 28. The emitter electrodes of transistors 25 and 26 are connected to positive supply conductor 16 and the base electrodes of transistors 25 and 26 are connected together and to node 30, which is connected to the emitter of transistor 24.

As mentioned, the negative feedback loop attempts to keep the magnitudes of the emitter currents of transistors 12 and 14 substantially equal by regulating the voltage at node 32 to the band-gap voltage level for silicon, $E_{G0}$. More specifically, if the voltage at the commonly connected bases of transistors 12 and 14 becomes smaller than $E_{G0}$ then the reduced voltage across resistor 20 enables the larger emitter area of transistor 12 to conduct more of the total current through resistor 22 than is conducted by transistor 14. As transistor 12 becomes more conductive, the collector voltage thereof decreases enabling PNP transistor 24 to become more conductive because the base-to-emitter voltage across transistor 24 then increases. More specifically, the emitter voltage of transistor 24 is clamped to one base-to-emitter voltage below the voltage on power supply line 16 by the base-to-emitter junctions of transistors 25 and 26. Thus, if the base voltage of transistor 24 is pulled in the negative direction by transistor 12 becoming more conductive then transistor 24 becomes more conductive thereby allowing transistors 25 and 26 to become more conductive by conducting their base currents and by pulling the commonly-connected bases of transistors 25 and 26 toward the negative potential. Consequently, more collector current is then made available by PNP transistor 26 to drive the base of NPN transistor 28. Accordingly, output transistor 28 is rendered more conductive which provides a current of increased magnitude to the commonly-connected bases of transistors 12 and 14. This increases the magnitude of the undesirably low voltage at the bases of transistors 12 and 14 until the output voltage at terminal 32 reaches the desired band-gap level, $E_{G0}$.

Alternatively, if the common base voltage of transistors 12 and 14 becomes too high, then the current through and voltage across resistor 22 are increased which renders transistor 12 less conductive, thereby resulting in PNP current mirror transistors 24 becoming less conductive. Thus transistors 25 and 26 become less conductive, which reduces the base-drive voltage and current for output transistor 28. Consequently, the base voltages of transistors 12 and 14 are regulated to a lower value until the output voltage reaches the desired band-gap level.

If transistors 12 and 14 have equal emitter currents and different emitter-to-base junction areas, then the difference voltage $\Delta V_{BE}$ is developed across emitter resistor 20. The current through resistor 20 is also directly proportional to $\Delta V_{BE}$. Series-connected resistor 22 conducts the emitter currents of both transistors 12 and 14. Under these conditions, it is well known that the voltage developed across resistor 20 is independent of the actual emitter current and is a linear function of absolute temperature T, with a positive TC. Since the magnitudes of the currents in transistors 12 and 14 are assumed to be equal, the current in resistor 22 has twice the magnitude of the current in resistor 20 and the voltage across resistor 22 thereby varies directly with T and has a positive TC. The voltage at node 32 then equals the sum of the base-to-emitter voltage of transistor 14 and the voltage across resistor 22. Since the VBE of transistor 14 has a negative TC and the voltage across resistor 22 has a positive TC, it is possible to provide a voltage having either a positive, negative, or substantially zero TC at outut terminal 32 by properly selecting the values of any or all of resistors 20 and 22.

Unfortunately, if the voltage between conductors 16 and 18 has a varying magnitude, the currents through transistors 12 and 14 of circuit 10 are not equal. More specifically, each of PNP current mirror transistors 25, and 26 have a collector-to-emitter resistance depicted by dashed resistors 36. PNP current mirror transistor 24 has collector-to-emitter resistance depicted by resistor 37. NPN transistors 12 and 14 have collector-to-emitter resistance depicted by dashed resistors 38. The resistances of resistors 38 is unequal to the resistances of resistors 36 and 37. Assume, for purposes of illustration, that the magnitude of the voltage between conductors 16 and 18 change because of ripple or for some other reason by a certain amount ($\Delta V_{cc}$). Since the collector of transistor 12 is two base-to-emitter voltage drops below supply line 16, the $\Delta V_{cc}$ across the series circuit leg including transistors 12 and 25 will occur across collector-to-emitter resistance 38 of NPN transistor 12. Furthermore, since node 40 at the base of transistor 28 is clamped to one base-to-emitter voltage drop above the band-gap voltage at output terminal 32, the $\Delta V_{cc}$ across the series circuit leg including transistors 26 and 14 will occur across the collector-to-emitter resistance 36 of PNP transistor 26.

Since the collector-to-emitter resistance 36 of PNP transistor 26 is different than the collector-to-emitter resistance 38 of NPN transistor 12, the variations in line voltage will cause different amounts of current to flow through these equivalent resistances. The difference in these resistances may be as much as 2:1, thereby imbalancing the current flow through transistors 12 and 14 and having a deleterious effect on the regulating ability of circuit 10. As a result, in the past it has been necessary to include a power supply voltage pre-regulator 42, shown in dashed form, connected between a main power supply conductor line 44 and $V_{cc}$ conductor 16. This circuitry undesirably increases costs by decreasing yield and taking up chip area.

Furthermore, PNP transistors of 24, 25, and 26 are in the signal negative feedback loop thereby requiring a large compensation capacitor 46 to be connected from node 40 to negative power supply conductor 18. This large capacitor takes up undesired chip space if provided on the integrated circuit or, if provided externally, requires additional pinouts thereby undesirably increasing costs and complexity.

Figure 2:
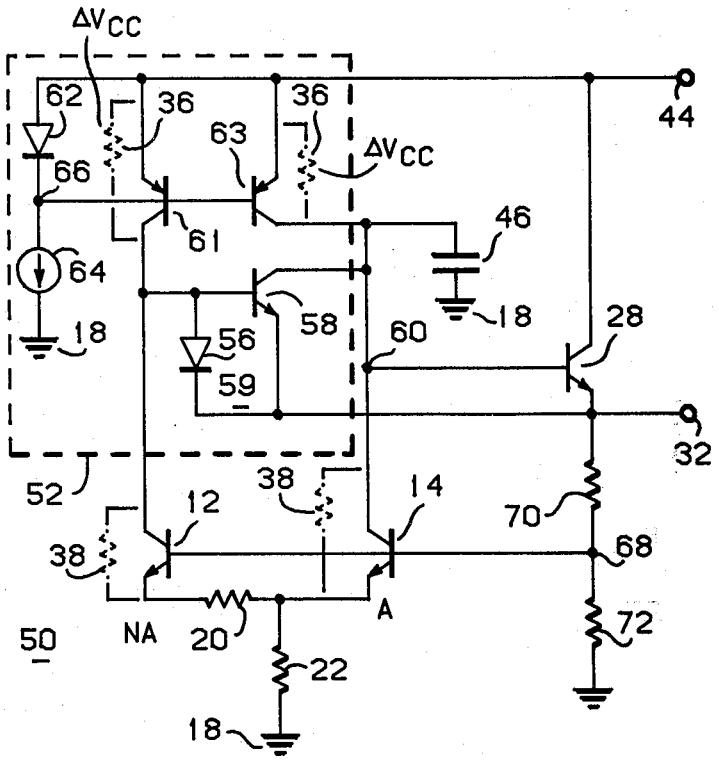
FIG. 2 is a schematic diagram of a voltage reference source of one embodiment of the invention.

FIG. 2 is a circuit diagram of a regulating voltage source 50 in accordance with the invention which has a high degree of rejection to variation in power line voltages and requires a smaller frequency compensation capacitor. The same reference numbers are used in FIG. 2 to designate components of circuit 50 having generally the same functions as those previously described with respect to circuit 10 of FIG. 1. Regulator 50 includes circuitry shown in dashed block 52 which is different in structure and operation from the corresponding circuitry of FIG. 1. Circuit 52 enables the magnitudes of the currents through transistors 12 and 14 to remain substantially equal even though subjected to variations in the magnitude of the power supply line voltage between terminal 44 and conductor 18 thereby eliminating the need for pre-regulator 42.

Some of the circuitry of block 52 along with NPN output transistor 28 provides negative signal feedback. Diode 56 and NPN transistor 58 form a current mirror 59 which is part of the negative feedback signal path. Diode 56 can be a diode-connected NPN tansistor of known configuration. PNP constant current supply transistors 61 and 63 each include emitter electrodes connected to power supply line 44 and commonly-connected base electrodes. PNP transistors 61 and 63 are not in the negative feedback signal path.

The collector electrode of transistor 61 is connected to the anode of diode 56 and to the collector electrode of reference voltage cell transistor 12. The collector electrode of transistor 63 is connected through node 60 to the base of output NPN transistor 28 and to the collector electrode of current cell transistor 14. NPN differential-to-single ended converter output transistor 58 includes a base electrode connected to the anode of diode 56, an emitter electrode connected to the cathode of diode 56 and a collector electrode connected to node 60.

Diode 62 and current source 64 are connected in series between power supply conductor 44 and conductor 18. Node 66 between diode 62 and current source 64 is connected to the commonly-connected bases of transistors 61 and 63, and current source 64 provides bias thereto.

Since the base-to-emitter junction of diode-connected transistor 56 is connected in parallel with the base-to-emitter junction of transistor 58, the base-to-emitter or anode-to-cathode voltage of transistor 56 will tend to drive transistor 58 to conduct a current having a magnitude which increases when the current through transistor 56 increases and which decreases when the current through transistor 56 decreases. If transistors 56 and 58 have matched geometries, the collector current of transistor 58 will closely match or mirror the collector or anode current of transistor-connected diode 56, assuming that errors caused by the base currents and emitter mismatch thereof can be neglected. Generally, since the betas of NPN transistors manufactured by present-day monolithic integrated circuit processes are relatively high, the base current errors of mirror circuit 59 including devices 56 and 58 can be neglected for most practical purposes.

During quiescent operation, the sum of the magnitudes of the currents from PNP constant current source transistors 61 and 63, respectively, exceeds the magnitudes of the current drawn by transistors 12 and 14. Generally, constant current supplies 61 and 63 will provide currents of equal instantaneous magnitudes. The difference current between the magnitudes of the current drawn by transistor 12 and the magnitude of the current supplies by transistor 61 biases diode-connected transistor 56 which in turn biases current mirror output transistor 58. The current difference not drawn by transistors 58 and 14 from transistor 63 biases NPN output transistor 28.

The aforementioned active or signal negative feedback loop including devices 56, 58 and 28 enables the magnitudes of the emitter currents of transistors 12 and 14 to be substantially equal by regulating the magnitude of the voltage at node 68 between resistors 70 and 72 which are connected in series between output terminal 32 and negative supply conductor 18. These resistors enable the voltage at output terminal 32 to be greater than the band-gap voltage, $E_{GO}$. The commonly-connected bases of transistors 12 and 14 are connected to node 68. More specifically, if the voltage at the commonly-connected bases of transistors 12 and 14 becomes too small, then the voltage drop across resistor 20 becomes small enough to allow the emitter area of transistor 12 to conduct more of the total current through resistor 22 than is being conducted by transistor 14. As a result, the collector current of transistor 12 increases.

Since PNP current source transistor 61 provides a constant current determined by current source 64, the magnitude of the current supplied to diode 56 is decreased because of the increased collector current drawn by transistor 12. Since the base-to-emitter junction of transistor 58 is connected in parallel with diode 56, transistor 58 tends to conduct or "mirror" less current in response to the anode-to-cathode junction voltage of diode 56 decreasing. Consequently, more of the current from PNP current supply transistor 63 is available to drive the base electrode of NPN output transistor 28. Accordingly, transistor 28 is rendered more conductive which provides a current of increased magnitude through resistors 70 and 72, which increases the voltage across resistor 72 and the base voltages of transistors 12 and 14. Thus transistor 14 is rendered equally more conductive.

Alternatively, if the base voltages of transistors 12 and 14 become too high, then the voltage across resistor 22 is increased. This negative feedback voltage renders transistor 12 less conductive thereby resulting in current mirror diode 56 and current mirror transistor 58 becoming more conductive. Thus, transistor 28 becomes less conductive which reduces the base drive voltage across resistor 72 for transistors 12 and 14. Thus, the negative feedback loop stabilizes the magnitude of the voltage at terminal 68 which, along with current mirror diode 56 and current mirror transistor 58, enables the magnitudes of the collector currents transistors 12 and 14 to be substantially equal. If transistors 12 and 14 are closely matched then the magnitudes of the emitter and base currents thereof are also substantially equal.

Node 68 between resistors 70 and 72 provides a voltage which is a predetermined fraction of the voltage at output terminal 32. The magnitude of the voltage at node 68 can be optimumized for achieving an output voltage having a predetermined TC. The output voltage at terminal 32 then will be some predetermined multiple of the voltage at node 68 depending upon the relative magnitudes of the resistances of resistors 70 and 72. The regulated voltage at terminal 32 is directly applied to the cathode electrode of diode 56, and to the emitter electrode of transistor 58. This particular connection performs an important role in allowing transistors 12 and 14 to have identical collector potentials. The cathode of diode 56 and the emitter of transistor 58 can be connected to any potential $1V_{BE}$ below node 60 and don't necessarily have to be connected to node 32.

Frequency compensation capacitor 46 is connected between the base electrode of transistor 28 and negative or ground supply conductor 18. Since one NPN transistors or 56, 58, 28, 12 and 14 have been utilized in the negative feedback loop of circuit 50, capacitor 46 can have a lower value than capacitor 46 of FIG. 1 thereby taking up less chip area than if PNP transistors 24, 25 and 26 are utilized in the feedback loop, for instance. The minimized capacitance of capacitor 46 enables decreased chip size, thereby increasing yields and decreasing the cost of the resulting integrated circuit for a given bandwidth of operation. Also, regulator 10 can respond to load current transients much more quickly with capacitor 46 having a lower value of capacitance than if capacitor 46 had a higher value of capacitance, as in many prior art configurations.

Regulator circuit 50 also has immunity against variations in the magnitude of the power supply voltages between conductors 44 and 18. More specifically, PNP current supply transistors 61 and 63 each have a PNP output resistance shown between the collector and emitter thereof in dashed form and designated by reference number 36. The collector of transistor 61 is held to or clamped to one base-to-emitter voltage drop above the output voltage at terminal 32 by diode 56 and the collector transistor 63 is held to one base-to-emitter voltage above the output voltage at terminal 32 by transistor 28. As the magnitude of the power supply voltage changes in response to ripple or for some other reason, the change in voltage $\Delta V_{cc}$ occurs across resistors 36 of PNP current supply transistors 61 and 63, rather than across resistors 38 of NPN transistors 12 and 14. Thus the differential current magnitude in transistors 12 and 14 remains unchanged. Moreover, the base widths of transistors 12 and 14 are not modulated due to the supply voltage change. Since the differential currents through transistors 12 and 14 remain unchanged, the regulation performed by transistors 12 and 14 of circuit 50 is relatively unaffected as compared to the regulation performed by transistors 12 and 14 of regulator circuit 10, for instance. Consequently, it is not necessary to utilize a power supply voltage regulator circuit such as 42 with circuit 50 for many applications where such a power supply voltage regulator circuit would be required if the circuitry 52 had not been employed.

Therefore, voltage reference circuit 50 has been described which is suitable for use as a general purpose voltage reference source having a relatively simple configuration. Circuit 50 has a high degree of rejection to variation of the magnitude of the power supply voltage between conductors 18 and 44 because of the circuitry included in dashed block 52. Also, because only NPN devices 56, 58, and 28 are included in the negative signal feedback path, frequency compensation capacitor 46 can have a much smaller value and therefore be of much smaller size than in prior art configurations, such as voltage regulator circuit 10 of FIG. 1.

I claim:

1. A voltage reference circuit for providing a reference voltage having a substantially constant magnitude at an output terminal thereof, including in combination:

first and second voltage reference transistors of a particular conductivity type and each having emitter, base, and collector electrodes;

a negative feedback loop interconnecting said first and second voltage reference transistors and the output terminal of the voltage reference circuit, said negative feedback loop enabling the currents through said first and second transistors to have a predetermined non-unity ratio of current densities, said negative feedback loop further including a current mirror circuit having a diode means with first and second electrodes, said first electrode of said diode means being coupled to said first reference transistor, said diode means having a junction, and said current mirror circuit having further transistor means of said particular conductivity type with emitter, base, and collector electrodes, said further transistor means having a base-to-emitter junction coupled in parallel with said junction of said diode means, said collector electrode of said further transistor means being coupled to said second voltage reference transistor; and means coupled to said emitter electrodes of said first and second voltage reference transistors for developing a voltage having a positive temperature coefficient in response to said non-unity ratio of current densities, circuit meeans combining said voltage having said positive temperature coefficient with the emitter-to-base voltage of one of said first and second voltage reference transistors to produce a combined voltage in said negative feedback loop.

2. The voltage reference circuit of claim 1 further including:

means for applying a voltage having a regulated magnitude to said emitter electrode of said further transistor means.

3. The voltage reference circuit of claim 1 wherein said particular conductivity type is NPN.

4. The voltage reference circuit of claim 1 further including:

first current supply means having an output terminal coupled to said diode means; and second current supply means having an output terminal coupled to said further transistor means.

5. The voltage reference circuit of claim 4 wherein said first and second current supply means provide currents of equal magnitudes.

6. The voltage reference circuit of claim 4 wherein said first current supply means and said second current supply means each include a transistor of a conductivity type other than said particular conductivity type.

7. A voltage reference circuit adapted to be powered by a power supply providing a supply voltage of varying magnitude, the voltage reference circuit providing a reference voltage having a substantially constant magnitude at an output terminal thereof while having a high degree of rejection to the varying magnitude of the power supply voltage, including in combination:

first power supply conductor means;

second power supply conductor means;

first and second voltage reference transistors of a particular conductivity type each having emitter, base, and collector electrodes;

circuit means electrically coupling said emitter electrodes of said first and second voltage reference transistors to said second supply conductor;

differential-to-single ended converter means coupled between said collector electrodes of said first and second transistors, said differential-to-single ended converter means including diode means with first and second electrodes and further transistor means with emitter, base, and collector electrodes, said first electrode of said diode means being coupled to said first reference transistor and said emitter and base electrodes of said further transistor means being coupled to said diode means;

first current supply means of a particular configuration being coupled to said first electrode of said diode means and to said collector electrode of said first voltage reference transistor; and second current supply means having a configuration similar to that of said first current supply means, said second current supply means being coupled to said collector electrode of said second voltage reference transistor and to said further transistor means, said first and second current supply means being coupled to said first power supply conductor and being responsive to variations in the magnitudes of the voltages between the first and second power supply conductors to provide substantially equal currents, said first and second voltage reference transistors having substantially no change in differential collector current in response to the power supply voltage of varying magnitude.

8. The voltage reference circuit of claim 7 wherein:

said diode means includes a diode connected transistor;

said voltage reference circuit further including output transistor means connected between said collector electrode of said further transistor means and said base electrodes of said first and second voltage reference transistors; and said first and second voltage reference transistors, said diode means, said further transistor means, and said output transistor means all being of the same particular conductivity type.

9. The voltage reference circuit of claim 8 further including frequency compensation capacitive means connected to said base electrode of said output transistor means, and said particular conductivity type being of the NPN variety to facilite said capacitive means having a minimum size.

10. The voltage reference circuit of claim 8 wherein said first and second current supply means each include a transistor of the conductivity type other than said particular conductivity type.

11. The voltage reference circuit of claim 8 wherein:

said output transistor means has a collector electrode connected to said first power supply conductor, and an emitter electrode connected to said second electrode of said diode means and to said emitter electrode of said further transistor means.

12. The voltage reference circuit of claim 11 wherein:

said output transistor means has a base electrode connected to said second current supply means, the base-to-emitter junction of said output transistor means and said diode means respectively clamping the voltages across said first and second current supply means to the same potential so that the changes in the magnitude of the power supply voltage produce substantially idenical changes in the currents of said first and second constant current supplies to provide substantially no change in the magnitude of the differential current therebetween.

* * * * *

UNITED STATES PATENT AND TRADEMARK OFFICE

CERTIFICATE OF CORRECTION

PATENT NO. : 4,349,778

DATED : September 14, 1982

INVENTOR(S) : William F. Davis

It is certified that error appears in the above-identified patent and that said Letters Patent are hereby corrected as shown below:

Claim 9, line 5, change "facilite" to

--facilitate--.

Claim 12, line 9, change "idenical" to

--identical--.

Signed and Sealed this

Ninth Day of August 1983

[SEAL]

*Attest:*

GERALD J. MOSSINGHOFF

*Attesting Officer*

*Commissioner of Patents and Trademarks*